United States Patent [19]

Barnett

[11] Patent Number: 4,580,546

[45] **Date of Patent: * Apr. 8, 1986**

[54] CATALYTIC STOVE

[75] Inventor: Stockton G. Barnett, Garrettsville, Ohio

[73] Assignee: Condar Co., Hiram, Ohio

[ * ] Notice: The portion of the term of this patent subsequent to Oct. 18, 2000 has been disclaimed.

[21] Appl. No.: 512,130

[22] PCT Filed: Oct. 27, 1982

[86] PCT No.: PCT/US82/01516

§ 371 Date: Jun. 23, 1983

§ 102(e) Date: Jun. 23, 1983

[87] PCT Pub. No.: WO83/01673

PCT Pub. Date: May 11, 1983

[51] Int. Cl.[4] ..... F23L 13/02

[52] U.S. Cl. ..... 126/58; 126/77; 126/290; 110/214; 110/203; 422/176

[58] Field of Search ..... 422/177; 110/203, 211, 110/214; 126/77, 76, 83, 163 R, 58, 60, 65, 290

[56] References Cited

U.S. PATENT DOCUMENTS

| | | | |
|---|---|---|---|
| 2,962,987 | 12/1960 | Hebert et al. | 110/120 |
| 4,135,885 | 1/1979 | Wormser et al. | 422/142 |
| 4,221,207 | 9/1980 | Syme | 126/77 |
| 4,316,444 | 2/1982 | Gullichson | 126/77 |
| 4,319,556 | 3/1982 | Schwartz et al. | 126/163 R |
| 4,330,503 | 5/1982 | Allaire et al. | 422/177 |
| 4,353,349 | 10/1982 | Bormida, Jr. | 126/290 |
| 4,362,146 | 12/1982 | Schuller | 126/77 |
| 4,363,785 | 12/1982 | Willson | 110/211 |
| 4,373,452 | 2/1983 | Van Dewoestine | 422/177 |
| 4,373,507 | 2/1983 | Schwartz et al. | 422/177 |
| 4,409,956 | 10/1983 | Barnett | 126/290 |
| 4,422,437 | 12/1983 | Hirschey | 126/77 |
| 4,437,451 | 3/1984 | Wysong | 126/77 |
| 4,458,662 | 7/1984 | Barnett | 126/77 |
| 4,473,059 | 9/1984 | Nassom | 126/77 |
| 4,479,921 | 10/1984 | Allaire et al. | 431/171 |
| 4,483,312 | 11/1980 | Martensen | 126/77 |
| 4,484,530 | 11/1984 | Goetzman | 126/77 |
| 4,494,525 | 1/1985 | Albertsen | 126/77 |
| 4,502,395 | 3/1985 | Barnett | 126/77 |

*Primary Examiner*—Samuel Scott
*Assistant Examiner*—Helen Ann Odar
*Attorney, Agent, or Firm*—Fay, Sharpe, Fagan, Minnich & McKee

[57] ABSTRACT

A catalytic stove comprised of a housing having a fuel burning chamber and an effluent chamber separated by a domed common wall. An air inlet port is located in the fuel burning chamber and draft air is introduced to burning fuel through an apertured thermal control unit which detects changes in stove temperature. A closure flap is rotatable across the aperture. The thermal control unit, the flap and the aperture cooperate to ensure that the effective area of the aperture changes by an amount approximately proportional to the square of the magnitude of any change in the stove temperature detected by the thermal control unit. Effluent from the fuel flows substantially directly and smoothly from the fuel to a finned holder at the top of the domed wall. The fins then create turbulence in the combustible gases emanating from the burning fuel. The holder supports a secondary air introduction ring which uniformly introduces preheated secondary air to the combustible gases through a plurality of ports thus forming a substantially homogeneous mixture of gases which are then delivered to a catalyst above the dome.

14 Claims, 15 Drawing Figures

FIG. 5
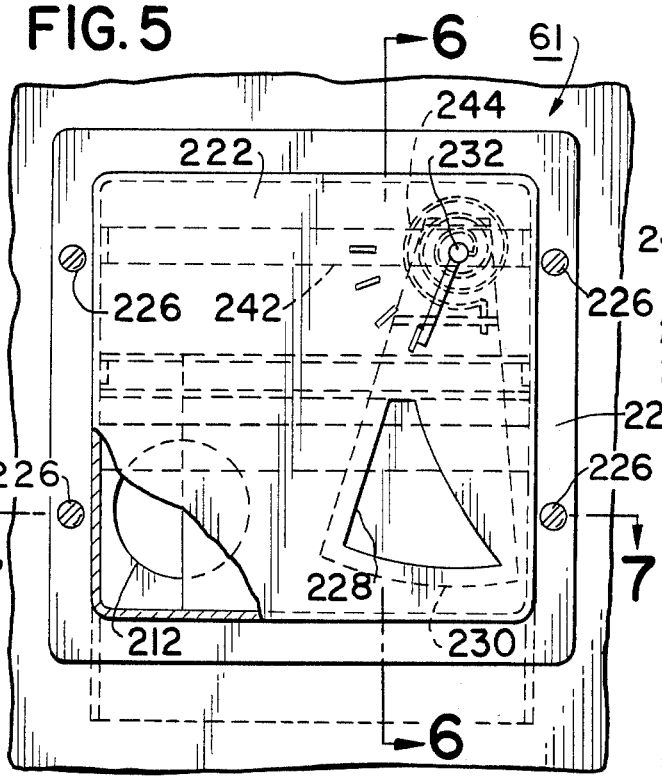
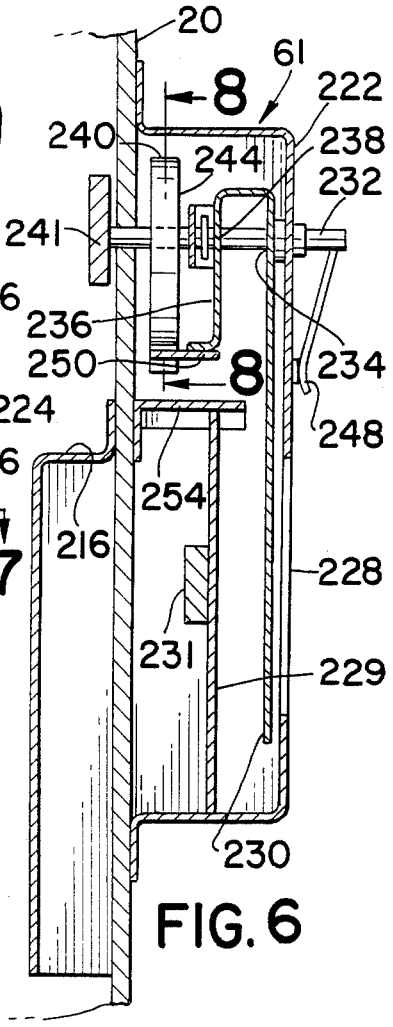
FIG. 6
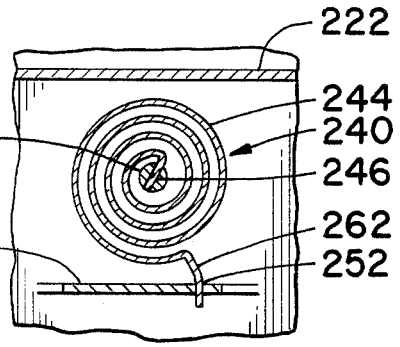
FIG. 8
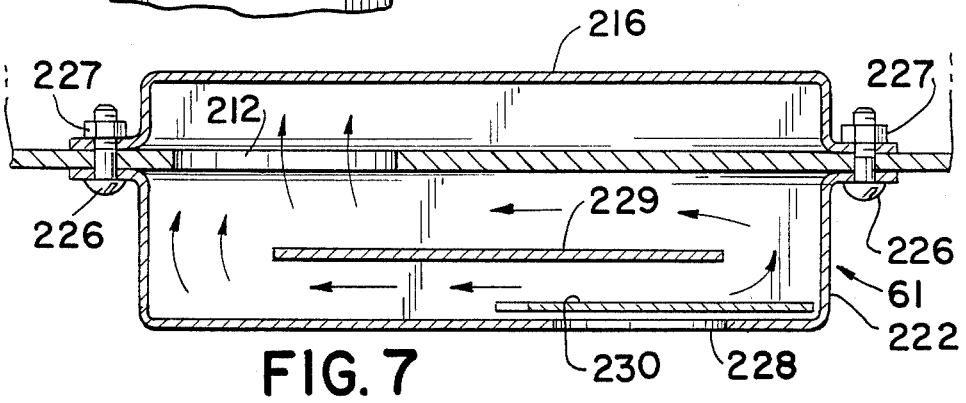
FIG. 7

FIG. 11
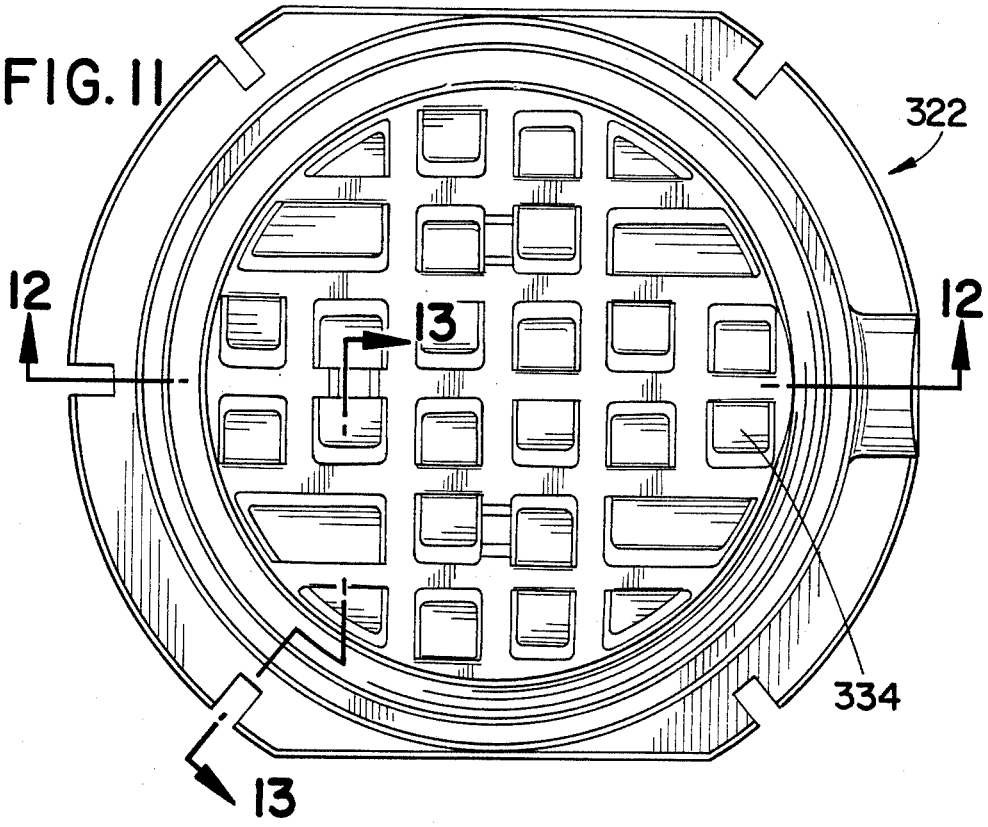
FIG. 13
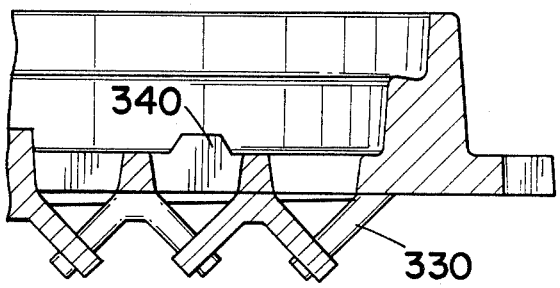
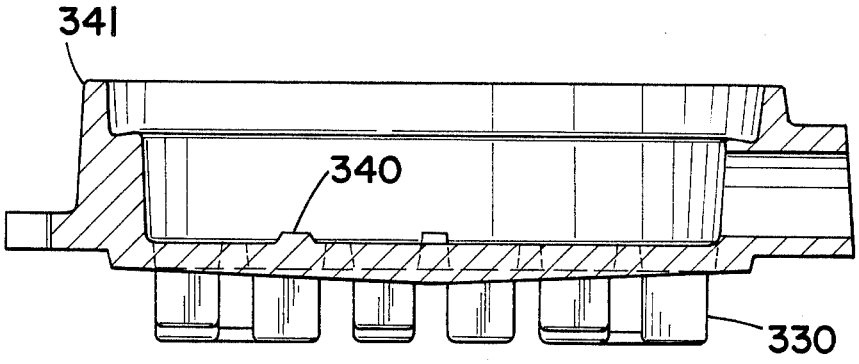
FIG. 12

CATALYTIC STOVE

BACKGROUND OF THE INVENTION

This invention pertains to the art of fuel burning devices and, more particularly, to a fuel burning device including an oxidation catalyst.

The invention is particularly applicable to woodburning stoves. The invention can be readily used in other fuel burning appliances in which an oxidation catalyst is employed, particularly in other solid fuel appliances.

It is highly desirable to control the temperature at which combustion occurs in the stove. When combustion occurs within the optimum range for heating a room to a desired temperature, the inhabitants of the room will be as comfortable as possible; clearly this will not be the case if the combustion occurs at a higher or a lower temperature or if its temperature oscillates widely. If the combustion temperature is too high, in addition to causing discomfort, the stove will consume more fuel than is necessary. In addition, with the stove at a high temperature, there is a danger of chimney fire due to high stack temperatures which are produced. Finally, an unnecessarily hot stove increases the danger of a person in the room suffering a severe burn from accidentally touching it or the stove igniting something flammable which is near the stove.

If the stove combustion temperature is too low, on the other hand, efficiency is again reduced, excessive CO and creosote is formed and there is a danger that the fire will go out, presenting the inconvenience of having to restart it.

Woodburning stoves equipped with thermostats which attempt to maintain the combustion temperature at the desired level are known. Such a stove is disclosed in U.S. Pat. No. 4,117,824, issued Oct. 3, 1978, to McIntire et al. In the McIntire et al patent, a damper is mounted in an air intake and can be rotated about its edge to control the quantity of air supplied to the stove combustion chamber. This controls the combustion temperature. A bimetallic coil is provided outside the air intake duct. One end of the coil is connected to the damper, and the other end of the coil is connected to a control knob. When the coil heats as a result of a rise in the stove temperature, it rotates and moves the damper in the closed direction. Conversely, a drop in the stove temperature as measured by the bimetallic coil results in the damper being opened further. The position of the damper can also be controlled manually by turning the control knob.

The combustion temperature in wood burning stoves with known thermostats typically exhibits oscillations of a very large amplitude, often reaching 70°-300° F. This is because known thermostats typically are not sufficiently sensitive to changes in the stove temperature. Such thermostats generally respond to temperature changes only very slowly and display a response that is very small in magnitude. As a result, by the time the thermostat reduces the air supply responsive to a temperature rise, the temperature has risen very high, and the amount of the reduction in the air supply is correspondingly large. Because of this, the combustion temperature falls dramatically. Due to its relative insensitivity, however, the thermostat detects the temperature drop only after the temperature has fallen as much as 70°-300° F. below its peak. The thermostat responds by drastically increasing the air supply, allowing the combustion temperature to rise very quickly to a new peak. As a result, the stove temperature oscillates wildly, instead of remaining at a stable level.

A stove controlled by such a thermostat thus reaches temperatures both substantially higher and substantially lower than the optimum combustion temperature and accordingly presents many of the risks and suffers from many of the drawbacks of manually controlled stoves.

Conventional woodburning stoves, fireboxes or fireplaces do not burn all the combustible substances of a conventional fuel such as wood. The smoke and gas effluent of a wood fire normally contains creosotes and substantial quantities of oxidizable substances such as combustible gases. Such gases can condense and become attached to a flue passageway during the emission of the effluent to the environment. Continued condensation and attachment may result in a particularly undesirable fire hazard in a flue or chimney, substantially hampering the efficiency of the burning device, and polluting the atmosphere.

In a wood burning operation, at a temperature of 250° F., oxidizable effluent gases are completely fogged (condensed droplets) while at 450° F. the effluent is 70-80% gas with the remainder comprising condensed droplets. Since the condensed droplets will not oxidize in a catalyst, an effluent reheating method or element has been necessary to raise the temperature of the effluent such that the condensed droplets would again become gaseous. Alternatively, the effluent was kept extremely hot, often by overfiring the stove.

Oxidation catalysts have been employed in combination with other fuel burning or incinerator devices for combusting smoke, creosotic flue gases and other objectionable components in the effluent. In order to promote such combustion, some prior art devices have employed various methods to reheat creosotic gases which have condensed to droplets during travel from the burning fuel to the catalyst.

Generally, however, none of the apparatus found in the prior art provided a system by which the combustion gases and secondary air could be homogeneously mixed before delivery to the catalyst nor did previous systems take advantage of the heat energy radiated from the catalyst to achieve a combustion function in the mixture of gases even before they entered the catalyst.

Additionally, most systems failed to take advantage of the heat emanating from the firebox itself, as opposed to providing a secondary heat source, to preheat the secondary air.

Also, the delivery rate of the secondary air has been inadequately controlled and has not been uniform. Moreover, insufficient attention has been paid to preventing the secondary air flow from becoming restricted. These failures have contributed to the inefficiency found in systems which comprise the prior art.

In other catalytic woodburning stoves found in the prior art, it has been necessary to operate the stove at a temperature higher than was desirable for residential operation, in order to operate the catalyst device without reheating the effluent. Such stoves would often consume six or more pounds of wood per hour in order to prevent some of the effluent from cooling to a temperature near 250° F. and condensing as it passed from the woodburning flame to the catalyst. Substantial eddying of effluent along the stove top and side walls would cause the effluent to cool. To prevent such cooling an undesirably high temperature had to be maintained so that the effluent would contain predominantly gases as opposed to condensed creosote droplets.

The present invention overcomes the above referred to problems. It provides a new catalytic stove which is simple in design, economical to manufacture and adaptable for use in residential environment. It is easy to install, and it operates at a temperature which is not undesirably hot, unsafe, or wasteful of energy. The present invention provides improved catalytic oxidation of effluent from a burning fuel.

The present invention combines a controlled air delivery system, a unique catalytic dome with a uniquely controlled and directed air flow. It typically lowers fuel useage from an objectionable six or more pounds per hour (a burning rate higher than normally encountered in homes) to a heretofore unobtainable two pounds per hour (a rate commonly desired in homes). This economy greatly expands the operating range of a catalytic woodburning stove.

BRIEF SUMMARY OF THE INVENTION

The present invention is a fuel burning apparatus or stove comprised of a housing containing a fuel burning chamber. The stove has means in the chamber for supporting the fuel which is to be burned. Access means are provided so that fuel may be easily placed in the stove. The stove also has a flue port which allows the products of combustion to leave the housing. The stove contains a domed or cathedral-like fuel burning chamber top wall which has a generally centrally-disposed port through which effluent may move to the flue port. A catalyst device is located contiguous to the port in the chamber top for catalytic burning of effluent flue gases. A controlled air inlet opening in the fuel burning chamber allows air to enter the stove.

The air inlet port is disposed contiguous to the fuel substance. It is in communication with an air passageway which has a selectively controllable air opening to the environment of the stove. The selectively controllable air opening includes a thermostatically controllable air opening closure device.

The thermostat of the invention is placed on the outer surface of the stove over the inlet port opening and controls the rate of air flow therethrough. To this end, the thermostat includes a housing having an opening therein to admit air and includes means for varying the effective size of the opening to thereby control the flow of air into the stove. The surface of the housing containing the opening may be either flat or curved. A flap is provided to adjust the size of the thermostat opening. The flap preferably moves parallel to the surface in which the thermostat opening is formed. A thermal control unit is provided to control the position of the flap relative to the opening as a function of stove temperature. The rate at which air is admitted to the stove is approximately proportional to the effective size of the thermostat opening as determined by the position of the flap.

According to the invention, the thermostat opening, the flap and the thermal control unit cooperate to adjust the effective size of the thermostat opening quadratically with changes in the stove temperature. Particularly, the effective area of the thermostat opening varies approximately in accordance with the following quadratic equation:

$$A = -k\,t^2 \qquad (1)$$

wherein A is the change in the effective size of the opening, k is a positive constant and t is the change in temperature in the stove. It should be understood that the thermostat need only approximate the relationship expressed in equation (1) to produce the improved results. For example, a variation from this relationship of approximately five percent (5%) will not significantly degrade the manner in which the thermostat effectively controls the temperature in the stove. On the other hand, the variation of some fifty percent (50%) of the relationship of equation (1) is unacceptable and will produce results substantially identical to the prior art thermostats.

It has been found that a thermostat having the foregoing characteristics reduces both the magnitude and the length (period) of oscillations in the stove temperature, which oscillations are extremely common with prior art thermostats. This stabilizes the stove temperature and therefore makes the temperature of the room heated by the stove more nearly constant, increasing the comfort of the inhabitants. Since such oscillations are especially common with prior art thermostats after wood is added to the stove and during the charcoal phase (3–8 hours after the beginning of a burn), it will be appreciated that the improvement in comfort afforded by the thermostat of the invention is considerable.

According to one preferred embodiment of the invention, the thermal control unit comprises a bimetallic coil located close to the stove wall (preferably within $\frac{1}{4}$ inch thereof) and shielded from cool drafts of air. While bimetallic coils have been used in the prior art, they have conventionally been either positioned adjacent the flue, rather than the stove wall, or positioned at a distance of 1–6 inches from the stove wall. When the shorter distance ($\frac{1}{4}$ inch) is used, it is found that the response time of the thermostat of the invention is reduced to about 10 minutes, compared to the typical response time of $\frac{1}{2}$–1 hour for prior art thermostats.

Moreover, since the change in dimension of the bimetallic coil depends upon the change of temperature experienced by the coil itself, placement of the coil immediately adjacent the stove wall greatly increases the magnitude of the coil response to a change in the stove temperature. As a result, it is possible to use the coil to control the flap position directly, e.g., by connecting one end of the coil directly to the flap. The change in dimension of the coil responsive to stove temperature changes is essentially linear in the temperature range of interest. The quadratic relationship between the effective area of the opening and temperature is effected by making the edges of the flap or the thermostat aperture, or both, curved. If the proper curvature is provided, the change in the effective area of the opening produced by a given movement of the flap will be proportional to the square of the magnitude of the angular movement of the flap.

While close placement of the coil to the stove by itself is sufficient to improve the performance of the thermostat compared to the prior art thermostats at relatively low temperatures and when used with thick-walled stoves, it has been found that when the exterior temperature of the stove wall substantially exceeds 200° F. (and especially when it exceeds 300° F.), the quadratic relationship of air supply to temperature change is essential to minimizing oscillations in the stove temperature. This is also the case with very thin-walled stoves (on the order of 1/16th inch).

When a bimetallic coil is used and the flap and thermostat aperture are accordingly curved to provide the quadratic relationship between opening area and temperature, it is very rare that the area of the opening is ever reduced to zero, even at very high temperatures. This provides a significant additional advantage over the prior art, for the following reasons. With prior art thermostats, the air supply is often shut off completely when a high temperature is reached. When this occurs, the fire is nearly extinguished, and in order to re-establish it the air supply must be brought to a near maximum value. A sudden large increase in the air supply naturally results in a correspondingly great increase in the intensity of the fire, quickly raising the stove temperature. Prior art thermostats respond by drastically reducing the air supply, which again reduces the fire to a very low level. In this manner, relatively violent oscillations in the stove temperature are produced, with the consequent danger of fire and discomfort to the inhabitants of the room heated by the stove.

The stove is designed so that effluent emitted by burning fuel remains in a substantially gaseous state in the fuel burning chamber and then is burned by the catalyst before the effluent leaves the housing.

The catalyst is located above and in communication with a top wall port of the domed fuel chamber located above an intersection of the top wall and the side walls of the fuel chamber. The top wall of the fuel chamber is domed.

In accordance with a more limited aspect of the present invention, the domed top wall of the fuel burning chamber includes a selectively operable baffle and baffle opening disposed for communication with the flue port.

In accordance with yet another aspect of the present invention, a finned air diffuser is disposed contiguous to the catalyst device and includes an air passageway communicating the air diffuser with a secondary air inlet port. The diffuser is located between the catalyst and the means for supporting the fuel and the diffuser enhances oxidation of effluent gases.

The catalyst with which applicant's invention is designed to function could be of any of those which are now generally commercially available.

The catalyst is supported by the finned holder or diffuser which is normally placed above and downstream of the path of effluent emanating from the burning fuel. The finned holder creates turbulence in combustible gases generated by the burning fuel. Supported by the holder, and still further downstream, is the multi-ported secondary air delivery member. In the present invention, this member takes the form of a ring, although it could be of any suitable configuration. The system is designed so that the secondary air is preheated by the stove itself before its delivery above the holder. A flap or damper-like member may be employed to control the amount of secondary air which is to be mixed with the combustible effluent gases.

Overlying both the ring and the ring holder is the catalyst to which the homogeneously mixed combustible gases and secondary air are ultimately delivered.

The catalyst, multi-ported ring and holder are spaced from each other in such a manner that the catalyst and holder form a sealed chamber in which heat energy is transferred by radiation from the catalyst. The chamber also contains the ring through which the preheated secondary air is introduced.

The overall system is so designed that a secondary air supply tube is placed contiguous to the combustion chamber and secondary air flowing through the tube is preheated without the necessity of having a secondary heat source to accomplish the preheat function. Among other things, preheating the secondary air produces a positive draft through the secondary air supply tube. The secondary air supply tube and the ring are both configured in such manner that air flow is not restricted except for the intentional restriction created by an adjustable flap for fine tuning or by an emergency tongue in the throat of the ring.

The ports contained within the ring are of varying diameters so that an even secondary air flow is introduced in the chamber between the holder and catalyst. One benefit of applicant's apparatus and system is that it provides an optimum delivery of gases containing unburned chemical compounds, mixed with preheated secondary combustion air to a catalyst. The invention results in increasing efficiency by 10–20 percentage points relative to the methods and apparatus now employed to deliver gas to these same catalysts. It is an object of the stove and system to remove 95%–98% or more of the particulates. combustible gases and creosote emanating from a fuel source and to reduce carbon monoxide levels to less than 0.10%.

Other objects, benefits and advantages of applicant's invention and system method will become apparent upon a reading and understanding of the drawings and description.

BRIEF DESCRIPTION OF THE DRAWINGS

The preferred embodiment of the new catalytic stove is described in detail in this specification and illustrated in the accompanying drawings.

FIG. 5 is a view, partially in section, of the thermostat;

FIG. 6 is a view taken along line 6—6 of FIG. 5;

FIG. 7 is a view taken along line 7—7 of FIG. 5;

FIG. 8 is a detail in section of a bimetallic coil used as the thermal control unit in the thermostat;

FIG. 11 is a top view of the ring holder;

FIG. 12 is a view taken along line 12—12 of FIG. 11;

FIG. 13 is a view taken along line 13—13 of FIG. 11;

DETAILED DESCRIPTION OF THE INVENTION

Figure 1:
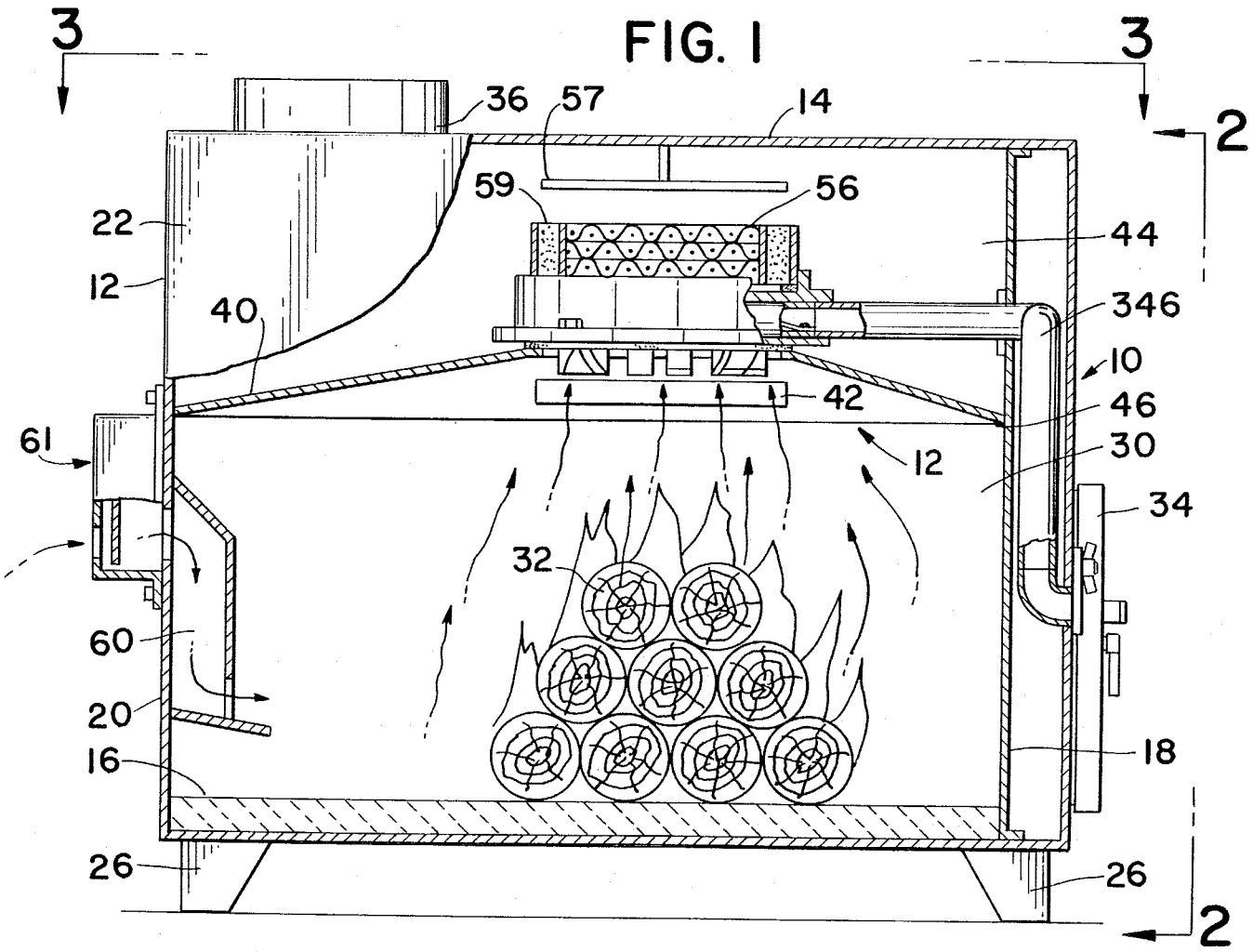
FIG. 1 is a partial cross-section of the stove.

Referring now the the drawings wherein the showings are for purposes of illustrating the preferred embodiment of the invention only and not for purposes of limiting same, the figures show a fuel burning apparatus comprising a catalytic stove 10 preferably employed for heating a personal residence.

More specifically, stove 10 includes a housing 12 having a generally box-like overall configuration. The housing 12 includes a top wall 14, a bottom wall 16, a front side wall 18, a back side wall 20, a first end side wall 22 and a second end side wall 24. The stove 10 may be spaced apart from a support surface with support legs 26. A fuel burning chamber 30 is included in housing 10 for receiving fuel such as wood logs 32. Conventional means are provided for supporting the fuel substance for burning in the chamber 30 and may comprise a bottom wall 16 of housing 10 or a conventional support grate (not shown). Access to the fuel burning chamber 30 is provided through insulated door 34 in front side wall 18. The doors may swing open or close and lock. A flue port 36 is provided in housing top wall 14 to provide for egress of effluent from the housing. Disposed intermediate of top wall 14 and bottom wall 16 is a fuel burning chamber top wall 40 depending from side walls 18, 20, 22 and 24. The top wall of the fuel chamber has a generally centrally-disposed port 42 for effluent chamber 44. Port 42 is preferably located above the intersection joints 46 of the top wall of the fuel burning chamber and the side walls such that the top wall 40 is inclined to comprise a cathedral of domed chamber type ceiling for fuel burning chamber 30. The fuel burning chamber top wall 40 preferably comprises four trapezoidally configured sheets.

A catalyst device 56 is located contiguous to the fuel burning chamber top wall port 42 for catalytic burning of effluent flue gases. The catalyst device 56 preferably comprises a honeycomb configuration constructed of platinum coated or palladium coated honeycomb or screen elements.

Suspended just above catalyst 56 is a catalyst cap member 57. This catalyst cap can be a thin stainless steel plate. The plate acts to raise the temperature of the top part of the stove, i.e., effluent chamber 44, thus enhancing the combustion efficiency of the catalyst. The plate also acts to protect the top of the stove itself from excess heat coming from the catalyst. The net effect of the plate acting in concert with the insulation 59 around the catalyst is to create what substantially is a secondary combustion chamber.

Air inlet port 60 to the fuel burning chamber 30 is provided contiguous to the fuel substance. Air inlet port 60 has a selectively controllable air opening exposed to the environment of stove 10, preferably in the form of the selectively controllable air opening closure device.

FIGS. 5–8 show an embodiment of the thermostat 61.

Thermostat 61 is coupled to the stove over aperture or port 60 provided in one wall thereof. The aperture admits air to the combustion chamber of the stove to oxidize the fuel contained therein. A preheating baffle 216 may be secured to the inner surface of the stove wall. Air admitted through the aperture is preheated by contact with the baffle 216 and is directed downward thereby to the base of the combustion region, both preheating the air and directing it to the base of the combustion zone. The preheating baffle 216 also serves to prevent drafts of cold air from entering the combustion zone directly, deflecting them to the bottom of the combustion zone.

The thermostat 61 is provided on the outer surface of the stove wall and controls the rate of air flow into the combustion chamber of the stove. The thermostat includes a housing 222, which in the embodiment of FIGS. 5–8 is generally rectangular in shape. The thermostat housing 222 includes a peripheral flange 224 secured to the stove all by screws 226 and nuts 227. An aperture 228 is formed in the front wall of the thermostat housing 222 and cooperates with a flap 230 and a coil 244 to vary the flow of air into housing 222 and thence into the combustion chamber of the stove. It will be noted that the thermostat aperture 228 is offset horizontally from the stove aperture. This prevents the entry combustion chamber of drafts of cold air into the stove. For the same purpose, a baffle 229 is mounted inside the thermostat housing 222, between and parallel to the stove wall and the front wall of the housing 222. The baffle 229 is secured to the housing 222 and supported by support bar 231. The flow of air through thermostat aperture 228, around baffle 229 and through the stove aperture 212 into the preheating baffle 216 is indicated by the arrows in FIG. 7. Flap 230 is mounted inside the thermostat housing 222 for rotation about shaft 232, to control the effective size of aperture 228. By rotation of the flap 230, it is possible to open aperture 228 completely, to close it completely or to open it to any intermediate degree that may be desired. The upper end 236 of flap 230 is bent away from the front surface of the housing 222 and folded down in the shape of a "U" as shown in FIG. 6. The portion 236 of the flap 230 which is bent backward and folded down is mounted on shaft 232 and is rotatable thereabout. Thus, the flap 230 is supported by shaft 232 at two points 234, 238. As best shown in FIG. 6, flap 230 lies immediately behind the front wall of the thermostat housing 222 and is rotatable in a plane parallel thereto.

A thermal control unit 240 is also contained in the thermostat housing 222 and is supported by a support bar 242. In the preferred embodiment, the thermal control unit 240 comprises a bimetallic coil 244 in the form of a spiral, although other shapes could also be used. The bimetallic coil 244 has its inner end connected to shaft 232, as, for example, by the insertion of the inner end of the coil 244 into a slot 246 in shaft 232. See FIG. 8. The shaft 232 extends through the support bar 242 and the front surface of the housing 222, with respect to both of which it is rotatable. The end of the support shaft 232 that projects through the housing 222 is provided with a pointer 248, which serves a purpose described below.

The bent-over portion 236 of the top of the flap 230 is secured to the outer end of the bimetallic coil 244. This may be achieved, for example, by providing a flange 250 projecting rearward from folded-over portion 236 of the flap 230 and inserting the outer end of the coil 244 into a slot 252 provided in the flange 250, as shown in FIG. 8, or by welding or in any other suitable way.

The bimetallic coil 244 of the thermal control unit is located within thermostat housing 222 in such a manner as to be in good thermal contact with the stove. For this purpose, the bimetallic coil 244 is preferably located approximately 0.6 cm. from the stove wall. Such a close placement of the coil 244 to the stove wall ensures that the coil 244 will respond quickly to changes in the stove temperature. The coil 244, due to its proximity to the stove wall, experiences greater temperature changes responsive to changes in the stove temperature than the prior art coils. As a result, the magnitude of the coil's response to a temperature change is sufficient to permit the coil 244 to be used to control the position of the flap 230 directly, as will be described below. In order to ensure that the coil 244 responds quickly and accurately to changes in the stove temperature, a baffle 254 is provided in the thermostat housing 222 immediately below the coil 244 to protect the coil 244 from drafts of air created by the flow of air into the combustion chamber of the stove. The baffle 254 also protects the coil 244 from soot.

In the embodiment shown in FIGS. 5–8, the thermal control unit 240 is made still more sensitive to temperature changes in the stove 210 in the following manner. Shaft 232 is extended through stove wall 214 and into the interior of the stove. A plate 241 of a highly heat-conductive material such as aluminum is secured to the end of shaft 232. The plate 241 acts as a heat sink, ensuring that the thermal control unit 240 is in good thermal contact with the combustion chamber of the stove. The end of shaft 232 need only extend far enough into the stove interior to permit the plate 241 to be secured thereto. The shaft 232 is preferably brass or aluminum.

When the stove combustion chamber temperature rises, the bimetallic coil 244 expands. Because the two metals of which the coil 244 is made have different coefficients of thermal expansion, the arc length of the coil increases, and the outer end of the coil 236 moves counterclockwise (in FIGS. 5 and 8), rotating the flap 230 in the same direction about the support shaft 232.

The bimetallic coil 244 is arranged in housing 222 such that when the stove temperature is low, i.e., below about 200° F., the flap is well to the left, as viewed in FIG. 5, and the thermostat aperture 228 is largely or completely unobstructed. As the stove temperature rises, the flap 230 is gradually moved counterclockwise, obstructing a progressively larger portion of the thermostat aperture 228 and thus reducing the air supply to the stove. Conversely, when the stove temperature falls, and more air is necessary to maintain combustion at the desired rate, the flap 228 is moved clockwise, enlarging the effective size (i.e., the unobstructed portion) of aperture 228 and increasing the air supply to the stove. In this manner, a proper air supply is assured.

In FIG. 8 it is seen that the outer end of the bimetallic coil may be a link 262 of a fusible metal. The link 262 is connected to the bimetallic coil in any suitable known manner and can be connected as shown.

The metal of which link 262 is made is selected to have a predetermined melting point. Thus, when the stove temperature approaches the melting point of the fusible link 262, the link either melts or, weakened by softening due to the temperature rise, breaks under the weight of the flap. The flap is then free to fall into the position in which it completely closes the thermostat aperture, cutting off the air supply to the stove, and allowing the fire therein to die. Thus, the fusible metal link prevents dangerously high temperatures from being reached and so serves as a guard against the hazard of fire.

The essential feature of the thermostat is that the thermal control unit, the thermostat aperture 228 and the flap 230 cooperate to ensure that when the stove temperature drops by a given amount, the air supplied to the stove is increased by an amount approximately proportional to the square of the drop in the stove temperature and that conversely, when the stove temperature rises, the air supply is decreased by an amount approximately proportional to the square of the temperature rise. Stated otherwise, it is essential that the effective size of the aperture 228 vary approximately in accordance with equation (1), supra.

The improvements in comfort and safety that are provided by the thermostat of the invention are indicated by relatively smooth graph curves. Both the magitude and the frequency of the variations in stove temperature are generally reduced to a great extent compared to the prior art. This is because the thermal control unit of the invention has a response time of only about ten minutes, or one minute (if a probe and inside plate, such as 241 of FIG. 6 are used) compared to a response time of a half hour to an hour with a conventional thermostat, and because of the quadratic relationship which the thermostat of the invention establishes between the air intake area and temperature changes in the stove.

Figure 2:
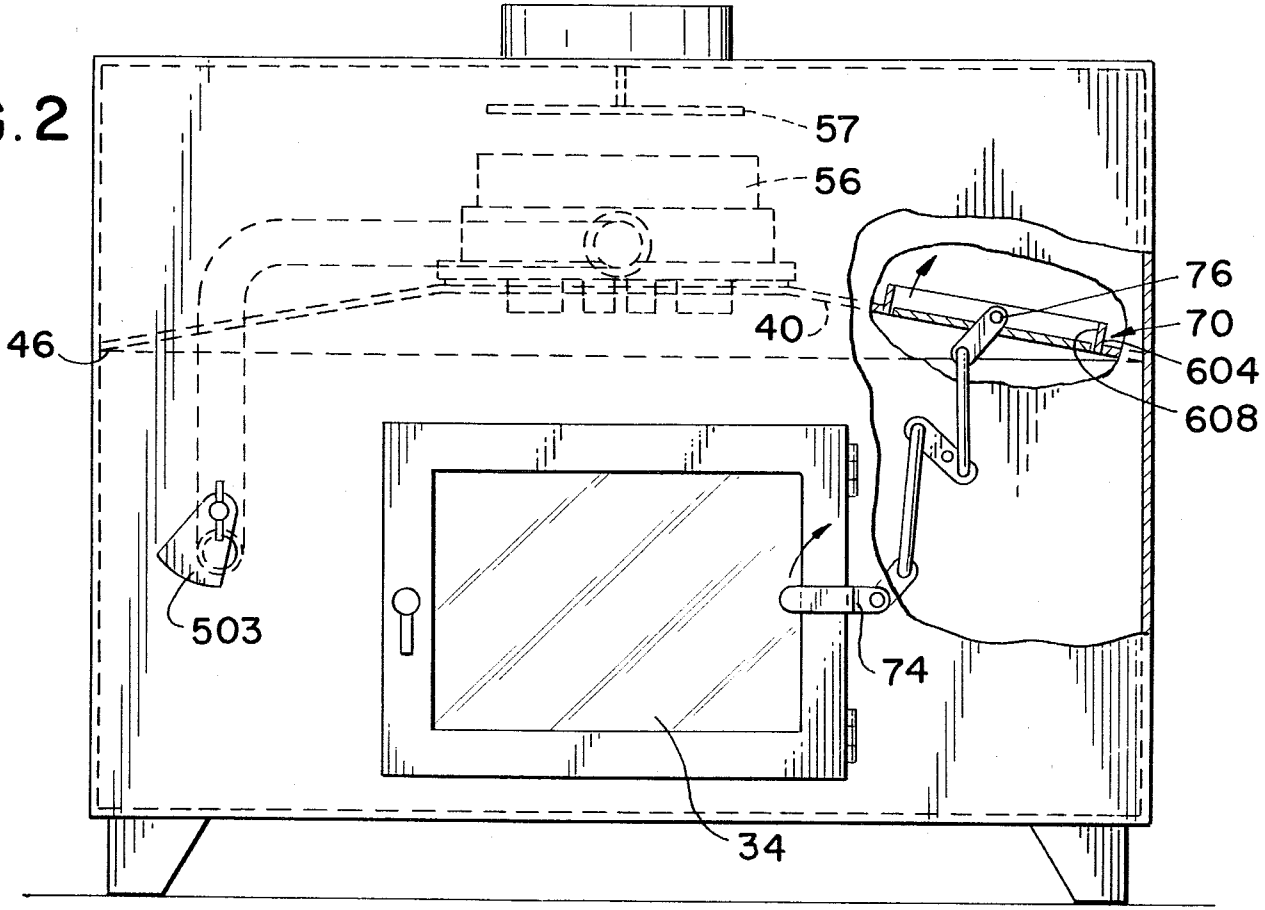
FIG. 2 is a cutaway view taken along line 2—2 of FIG. 1.
Figure 3:
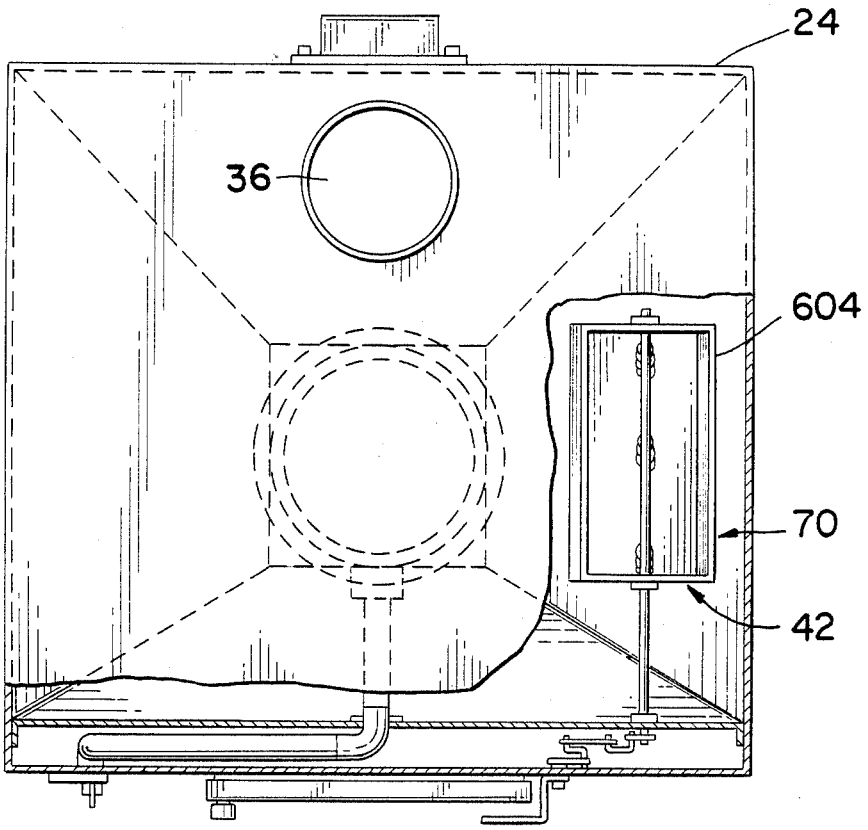
FIG. 3 is a cutaway view taken along line 3—3 of FIG. 1.
Figure 4:
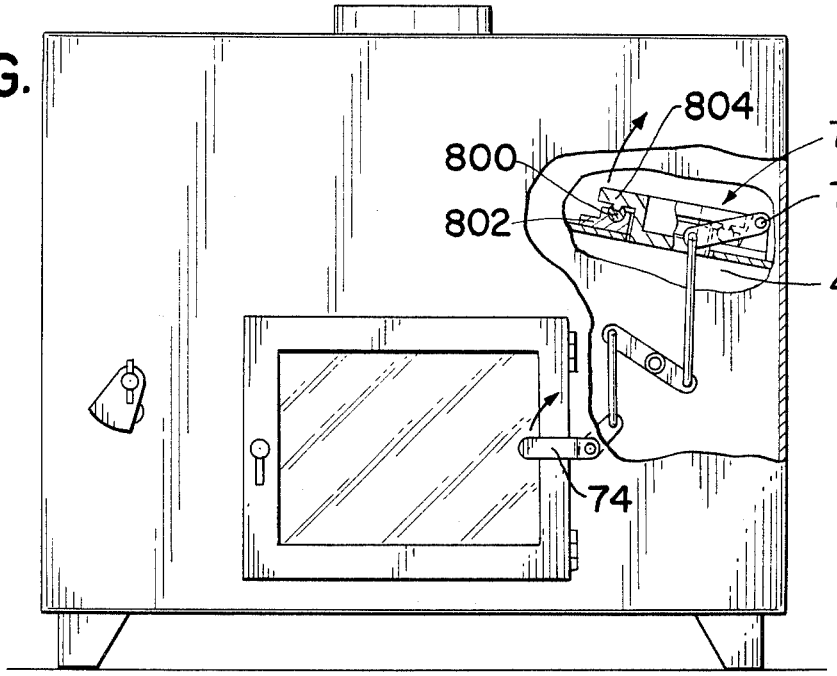
FIG. 4 is a cutaway view taken along line 2—2 of FIG. 1 showing a modified baffle.
Figure 9:
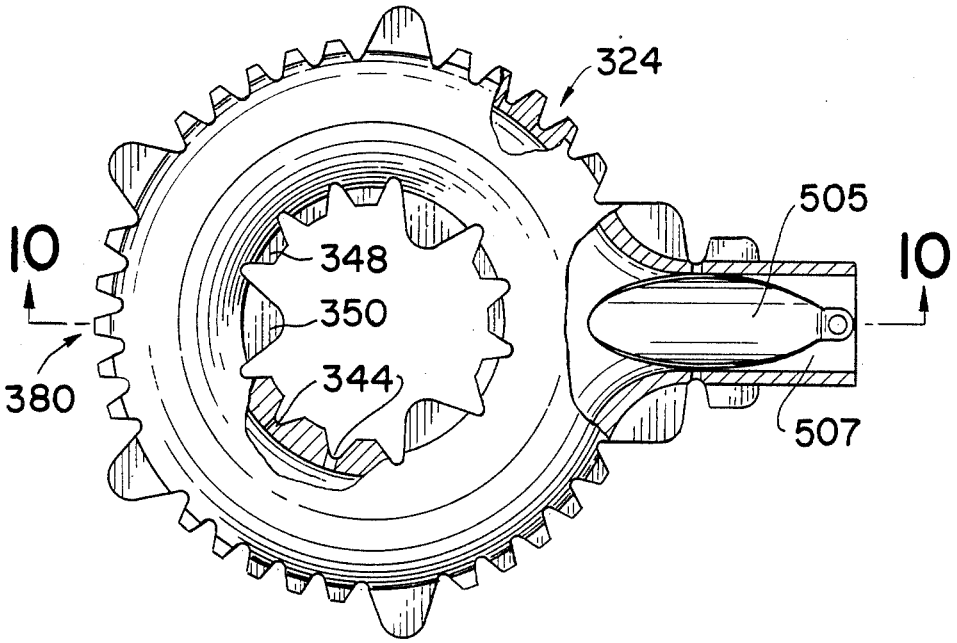
FIG. 9 is a top view of the ring.
Figure 10:
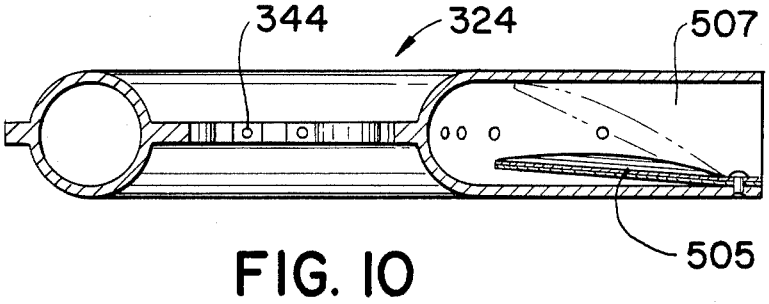
FIG. 10 is a sectioned side view of the ring.
Figure 14:
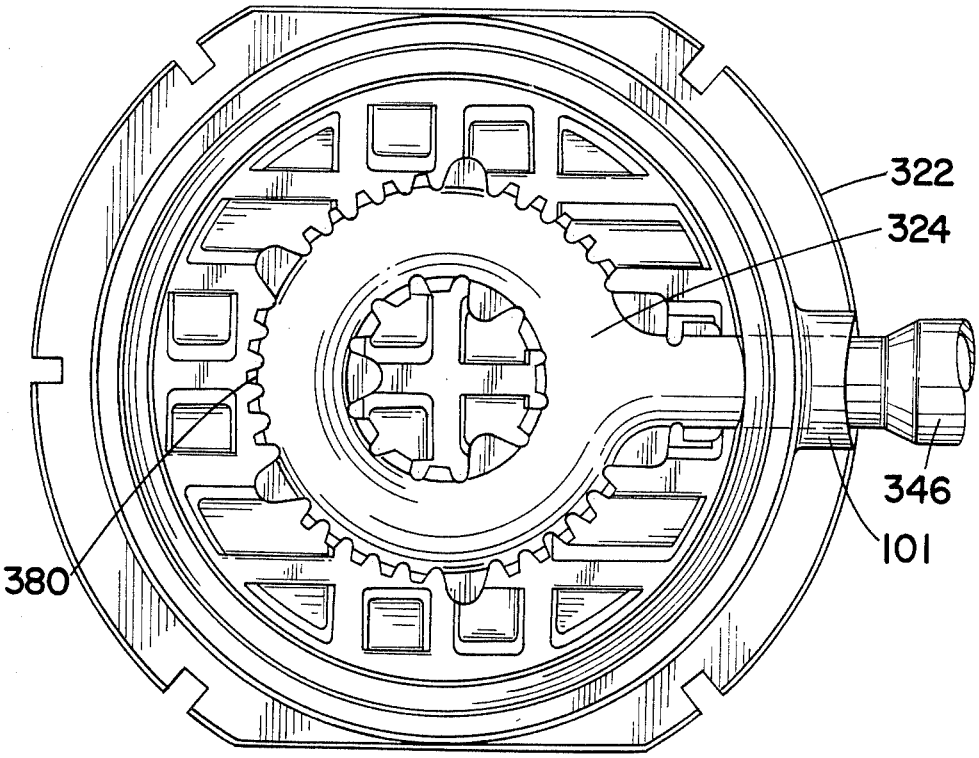
FIG. 14 is a top view of the assembled ring and holder.
Figure 15:
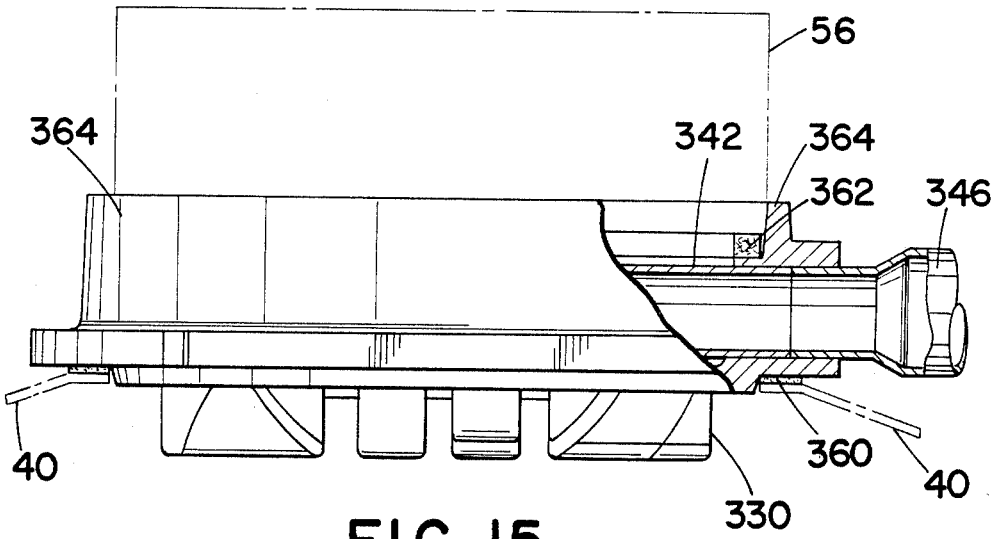
FIG. 15 is a side view, partially in section, of the ring holder and catalyst as it would be installed at the top of the catalytic stove.

With respect now to the downstream portion of the stove, a selectively operable baffle 70 and baffle opening 42 are included in the fuel burning chamber top wall 40 to provide an alternate egress port for effluent from the fuel burning chamber 30. Baffle 70 is operable with an operating handle 74 for swinging the baffle 70 about its hinges 76. In operation, baffle 70 is opened during igniting of the fuel supply 32 and initial heatup of the stove 10. It is normally kept open until the catalyst device 56 becomes operable to oxidize effluent gases. The baffle is also opened before the stove door is opened. To this end, the baffle handle forms an interlock with the stove door. It will be noted that several types of baffles are shown. The baffle of FIGS. 2 and 3 is essentially a butterfly-type baffle which, when closed, is flush with the top wall of the stove. The butterfly is contained within a housing 604. As soot builds up between the inside 608 of the housing, the operation of the baffle when the door to the stove is opened and closed will serve to clean the inside of the housing. Any soot remaining will be leveled and thus a fairly airtight seal will be obtained between the inside of the chamber 30 and chamber 44. It will be appreciated that relatively the same type of operation, i.e., that of providing a seal, is effectively producted by the baffle embodiment shown in FIG. 4. This embodiment comprises a heat-resistant rope 800 in a groove in housing 802 so that when cap 804, which overlies the housing and the compressible high temperature resistant rope, is closed a tight seal is formed between the aforementioned chambers 30 and 44.

It will be appreciated that regardless of the type of bypass baffle that is used in the top of the unit, it is preferable to have the operating mechanism for the baffle overlie the door or be arranged in such a relationship that the bypass baffle must be opened before the door can be opened thereby eliminating the possibility of smoke escaping into the room.

With particular attention to FIGS. 1–4 and 9–15, the improved operating characteristics of the new catalytic stove will be specifically discussed.

Cooling of effluent to form condensed creosotic droplets in conventional stove designs is at least partly caused by eddying of effluent from a burning fuel within the fuel burning chamber prior to egress of the effluent from the stove. Upon cooling, the effluent becomes a fog of condensed creosotic droplets which is an obnoxious waste product to the environment and causes a dangerous creosote buildup in the flue pipe. In order for the catalyst device in prior art stove designs to be operable, it was necessary to burn the fuel at an excessively high rate to raise the temperature such that even though eddying was substantial, the effluent would not cool to a level where it would substantially be comprised of condensed creosotic droplets.

In the present stove, effluent from the burning fuel is channeled along the smooth side walls 18, 20, 22 and 24 and the top wall 40 to the catalyst device in a manner which substantially avoids eddying at the fuel burning chamber side walls. Eddying is avoided because of the smooth and generally straightforward flow along the side walls and because of the incline of the fuel burning chamber top wall 40. It is not horizontal. Since eddying is minimized, cooling is minimized. The effluent is thus in a substantially gaseous state when it reaches the catalyst, even when the fuel is burned at the relatively low burn rates which are desirable in personal residences.

As explained, the air flow through the air inlet port 60 is selectively controllable at a single air opening by selectively controlling the area of the opening with an air opening control member. The control automatically opens or closes the air opening 228 for regulating air flow thereby raising or lowering the temperature of the fuel burning chamber.

When the fuel is burned, combustible gases containing unburned chemical compounds rise in the direction of arrows 12 toward the top of the combustion chamber. When the combustible gases are still within the combustion chamber, it is best to limit their turbulence as much as possible so that they do not condense and form droplets. Thus, it is preferred that a smooth walled combustion chamber, such as that shown, be employed. As explained, the chamber is so configured that combustible gases are directed in a fairly smooth path to the sloping top walls of the combustion chamber. Once reaching the top of the chamber, however, and before allowing the gases to exit the stove through the flue, it is desirable to provide a means for removing as much of the unburned chemical compounds and particulates as possible from the combustible gases. In order to accomplish this, applicant has placed a mixer and fuel burning assembly at the top of the combustion chamber above the burning fuel. The view of FIG. 1, when taken in conjunction with the view of FIGS. 2 and 15, best illustrates the placement of this assembly in the stove.

The assembly is comprised of a holder 322, a ring element 324 and a catalyst 56.

It is desirable to introduce preheated secondary air to the combustible gases at this point, thoroughly mix this secondary oxygen rich air with the combustible gases and pass the resulting homogeneous mixture through the catalyst. To obtain turbulence, the holder 322 has been provided with a plurality of fins 330 extending downwardly at approximately 45°. When the combustible gases reach these fins, severe turbulence in the combustible gases rising from the combustion chamber is produced. This agitated combustion gas rises through apertures 334 in the holder and into a small chamber 342 formed between and by the holder and the catalyst. Within this chamber and spaced slightly above the apertured portion of the holder by bosses 340 is the ring 324 for dispersing the secondary air. The walls 341 of the holder form a coupling 101 to secure the ring so that it is substantially centered in the holder. The top of the ring lies approximately 1.5 to 1.75 cm. from the bottom of the catalyst.

In the illustrations, the ring is substantially annular although it could be of any suitable configuration which would provide a substantially even distribution of secondary air in the chamber 342. To accomplish this even air distribution in the preferred embodiment, holes or apertures 344 are provided around the interior and exterior peripheries of the ring. These apertures are graduated in size such that the amount of air that is ejected from each is uniform. Thus, in the embodiment which is shown, the holes furthest from the secondary air tube 346 are generally larger than the apertures which lie closer to the source of the secondary air supply. The holes at the very furthest (380) are slightly smaller. This is because there is a net approximate doubling of air volume at this point.

The ring is supplied with a number of fins 348 located between each outlet hole. These fins serve to further heat and turbulate the gases and also serve the additional function of providing a seal between the holes.

Parenthetically, the larger tabs 350 are provided to enable spot welding equipment to join the ring together since it is generally first produced in two matching halves, the slots being cut into each of the two halves.

When the entire apparatus is installed in the combustion chamber, it is best to place a gasket 360 between the unit and the top wall of the combustion chamber. In order to maximize the mixing of the combustible gases and the secondary air, it is also desirable to place a gasket 362 betwee the wall 364 of the holder and the catalyst.

As has been mentioned, it is found to be desirable to preheat the secondary air. This has been accomplished by placing the secondary air supply means 346 in a contiguous relationship with the combustion chamber 30 and upper chamber 44. The objective is to utilize the heat generated by the burning fuel to preheat the secondary air, thus obviating the necessity of providing a secondary heat source but, also not to disturb smooth air flow within the stove.

It is best to space the ring a small distance from the top of the fins 330 to allow the wall effect to take place so that turbulent combustion gas flows freely around the ring and mixes with the fresh oxygen that is being emitted by induced draft from the multiple holes in the ring. Thus, mixing of the primary and secondary combustion gases occurs, and this mixture is then introduced into the catalyst.

It has been found that, due to the fact that the invention produces a catalytic operating temperature which is often in the range of 1000° to 1800° F., some heat energy is transferred by radiation to the chamber where the ring is located. This occasionally produces "precombustion" in this chamber at high burn rates. The high catalytic converter heat is thus transferred to the ring chamber 342, the ring and ring fins and also to the baffled holder or bottom plate thereby further heating the incoming gases and air.

It should be noted that it may be desirable to provide for variably controlling the amount of secondary air that is introduced through the ring, i.e., fine tuning the apparatus. This can be accomplished by means of a damper or flap 503 in the secondary air supply channel. It may also be accomplished by placing a bimetallic flap 505, in the throat 507 of the ring. This bimetallic flap will close if a predetermined temperature that would endanger the catalyst has been reached, i.e., it will shut off the secondary air by bending and closing the throat.

Thus it can be seen that in the downstream part of the invention an apparatus and a method is provided by which particulate and combustible gas removal can be accomplished. The combination of a finned holder in which the fins are preferably extended downwardly at an angle of between 40°–50°, a secondary air introduction member having graduated apertures to evenly distribute preheated secondary air and a conventional catalyst can be utilized to effect substantially better results than have been achieved by prior art apparatus and systems. These latter apparatus are placed above the domed top wall so that essentially only the fins protrude into the primary combustion chamber 30. Thus, smooth air flow is maintained in the primary combustion chamber.

It should be realized that although in the preferred embodiment the lower edge of the finned holder is secured to the top of the combustion chamber the particular configuration could be altered to accommodate different types of installations. These other installations would include at least a retrofit type unit for use on the top of or within the top of an existing stove, or the apparatus could be mounted in a flue pipe for capturing gases in pollution control systems. These types of adaptations of the instant invention are anticipated by the applicant. The combination of a multi-ported finned ring and baffled holder enable air and combustion gases to be substantially homogeneously mixed for more complete burning in the chamber between the catalyst and the holder, as well as in the catalyst itself.

Having thus described the invention with particular reference to the preferred embodiment, it is obvious that modifications and alterations will occur to others upon a reading and understanding of the specification. It is the intention of applicant to include all such modifications and alterations insofar as they come within the scope of the appended claims.

What is claimed is:

1. In a stove including a stove housing having a burning chamber, a bottom wall, side walls, a top wall and an effluent outlet flue, the improvement comprising:

a domed wall interposed between said burning chamber and said top wall and including a catalyst substantially at the peak of said domed wall, said catalyst being in effluent communication with said flue;

said domed wall and side walls comprising a substantially smooth path for an effluent emitted from a burning fuel such that said effluent emitted remains in a substantially combustible gaseous state in said burning chamber as it reaches the top of said domed wall;

an air inlet into the burning chamber having a selectively controllable opening at one terminal end exposed to the environment of said stove;

and wherein the amount of air entering the burning chamber is selectively controlled by an apparatus comprising:

a thermostat attached to the stove; means for defining a thermostat aperture; moveable means for adjusting the effective size of said thermostat aperture;

thermal control unit means for detecting changes in the temperature of the stove to which the thermostat is attached and for moving said moveable means for adjusting the effective size of the thermostat aperture as a function of said change in temperature; and, said moveable means, said means for defining a thermostat aperture and said thermal control unit means cooperating to cause the effective area of said thermostat aperture to change by an amount approximately proportional to the square of said change in temperature of said stove, said effective area being increased responsive to a fall in the stove temperature and being decreased responsive to a rise in the stove temperature.

2. The stove of claim 1 further comprising:

an apparatus for placement in an effluent path and at the top of said burning chamber which comprises means for creating turbulence in combustible gases emanating from combustible material being burned in the burning chamber; and, secondary air introduction means located above and downstream of the means for creating turbulence in the combustible gas.

3. The stove of claim 2 wherein the means for creating turbulence is a holder containing fins extending away from said catalyst and wherein the means for introducing secondary air is a multi-ported member and wherein the secondary air is mixed with the combustible gases to form a substantially homogeneous mixture and wherein this mixture then enters the catalyst.

4. The stove of claim 3 wherein entry means are supplied for selectively controlling entry of secondary air into the multi-ported member.

5. The apparatus of claim 2 further comprising a bypass baffle for allowing effluent to flow from the fuel burning chamber to the flue, said bypass baffle comprising a butterfly valve contained within a housing, said butterfly valve comprising wings for restricting the flow of fluid therethrough, said valve being designed to scrape the sides of the housing thereby cleaning said sides of soot and providing a tight seal between the wings of the butterfly and the housing walls when the baffle is closed.

6. The stove of claim 1 wherein said thermal control unit means has a substantially lineal response to changes in stove temperature and wherein said thermal control unit means comprises a bimetallic coil and wherein said bimetallic coil has an outer end secured to the moveable means; and further including shutoff means having a fuseable link coupling said bimetallic coil to said thermostat, said shutoff means being adapted to melt when said temperature in said housing rises above a predetermined level.

7. The stove of claim 1 wherein there is provided mixing means at the top of the domed wall acting in conjunction with the catalyst which comprises:

means for creating turbulence in the combustible gas, said means being located above the burning fuel and below the catalyst; and means for introducing secondary air to the turbulent combustible gas, said means being located above and in proximity to the means for creating the turbulence whereby the combustible gas and secondary air are substantially homogeneously mixed before entering the catalyst which, in turn, burns the homogeneously mixed gases.

8. The apparatus of claim 2, 1 or 7 wherein the catalyst lies above the dome; and wherein a bypass baffle is supplied at the top of the dome for selectively permitting effluent flow to said effluent outlet flue in the top wall.

9. The apparatus of claim 2, 1 or 7 wherein a baffle opening means is provided at the top of the dome such that when closed, it permits a smooth flow of effluent emanating from the burning wood and wherein said baffle is comprised of a housing having a compressible high temperature resistant rope providing a seal between said housing and an overlying selectively moveable cap for opening and closing the baffle opening through said housing.

10. A stove comprising:

a stove body defined by a bottom wall, side walls, and a top wall having an effluent outlet aperture therein;

a primary combustion chamber positioned within said stove body; and in communication with said effluent outlet aperture;

an air inlet into said chamber, said air inlet having a selectively controllable opening;

moveable means for adjusting the effective size of said opening; and, thermal control means for detecting changes in the temperature of the stove and moving said moveable means as a function of temperature to control the effective size of said opening wherein the effective size of said opening is changed by an amount approximately proportional to the square of a temperature change in the stove, the effective size being increased responsive to a fall in the stove temperature and being decreased responsive to a rise in the stove temperature.

11. The stove of claim 10 wherein said thermal control means includes a thermal control unit which has a substantially linear response to changes in stove temperature.

12. The stove of claim 11 wherein said thermal control unit includes:

a bimetallic coil having an outer end secured to said moveable means; and, a shutoff means having a fusible link coupling said bimetallic coil to said thermostat, said shutoff means being adapted to melt when the temperature sensed rises above a predetermined level.

13. The stove of claim 10 further comprising a domed wall positioned between said primary combustion chamber and said top wall, said domed wall and said side walls cooperating to provide a substantially smooth flow path for an effluent emitted by a burning fuel in said primary combustion chamber.

14. The stove of claim 13 further comprising:

a secondary combustion chamber positioned above said domed wall and in communication with said primary combustion chamber and said effluent outlet aperture; and, a catalyst device positioned in said secondary combustion chamber.

* * * * *